US010687584B2

(12) United States Patent
Austin

(10) Patent No.: US 10,687,584 B2
(45) Date of Patent: Jun. 23, 2020

(54) OVERSHOE

(71) Applicant: John R. Austin, Bradbury, CA (US)

(72) Inventor: John R. Austin, Bradbury, CA (US)

( * ) Notice: Subject to any disclaimer, the term of this patent is extended or adjusted under 35 U.S.C. 154(b) by 0 days.

(21) Appl. No.: 16/011,983

(22) Filed: Jun. 19, 2018

(65) Prior Publication Data

US 2019/0053575 A1 Feb. 21, 2019

Related U.S. Application Data

(60) Provisional application No. 62/521,665, filed on Jun. 19, 2017.

(51) Int. Cl.

| | |
|---|---|
| ***A43B 3/16*** | (2006.01) |
| ***A43B 13/28*** | (2006.01) |
| ***A43C 15/02*** | (2006.01) |
| ***A43B 3/18*** | (2006.01) |
| ***A43B 13/14*** | (2006.01) |
| ***A43B 13/18*** | (2006.01) |
| ***A43B 13/22*** | (2006.01) |

(52) U.S. Cl.

CPC ..... *A43B 13/28* (2013.01); *A43B 3/16* (2013.01); *A43B 3/18* (2013.01); *A43B 13/14* (2013.01); *A43B 13/181* (2013.01); *A43B 13/187* (2013.01); *A43B 13/22* (2013.01); *A43C 15/02* (2013.01)

(58) Field of Classification Search

CPC .. A43B 3/16; A43B 3/163; A43B 3/18; A43B 3/12; A43B 3/122; A43B 3/128

USPC ..... 36/7.1 R, 7.4, 7.5, 7.6, 7.7

See application file for complete search history.

(56) References Cited

U.S. PATENT DOCUMENTS

| | | | | | |
|---|---|---|---|---|---|
| 1,155,982 | A * | 10/1915 | Withycombe | A43B 5/18 | 36/7.5 |
| 2,108,656 | A * | 2/1938 | De Noronha | A43B 3/16 | 36/7.3 |
| 3,009,269 | A * | 11/1961 | Folk | A43B 3/16 | 36/7.5 |
| 3,699,926 | A * | 10/1972 | Stockl | A01K 1/0157 | 119/526 |
| 3,747,238 | A * | 7/1973 | Jankauskas | A43C 15/14 | 36/61 |
| 3,757,774 | A * | 9/1973 | Hatuno | A43B 3/128 | 601/28 |
| D238,538 | S * | 1/1976 | Smith | D6/582 | |
| 4,246,707 | A * | 1/1981 | Pedersen | A43B 3/16 | 36/100 |
| 4,478,901 | A * | 10/1984 | Dickens | A47G 27/0212 | 404/36 |
| 4,896,439 | A * | 1/1990 | Morgan | A43B 5/18 | 36/115 |
| 5,456,966 | A | 10/1995 | Austin | | |
| 7,779,560 | B2 * | 8/2010 | Kay | A43B 3/26 | 36/135 |

(Continued)

*Primary Examiner* — Marie D Bays

(74) *Attorney, Agent, or Firm* — John D. Carpenter

(57) ABSTRACT

A comfortable overshoe that can be worn over various types of footwear has a flexible, resilient sole and means for releasably attaching the overshoe to a boot or other footwear. The sole has a flexible, generally planar, medial wall, with a plurality of hollow domes formed in and extending from the top side of the medial wall. A plurality of triradial support members extend from the bottom of the medial wall and are spaced around the underside of each dome.

2 Claims, 7 Drawing Sheets

(56) References Cited

U.S. PATENT DOCUMENTS

| | | | | |
|---|---|---|---|---|
| 8,225,529 | B2 * | 7/2012 | Simms | A43B 5/185 36/7.1 R |
| D713,654 | S * | 9/2014 | Robbins, III | D6/582 |
| 9,622,545 | B2 * | 4/2017 | Bell | A43C 15/066 |
| D801,646 | S * | 11/2017 | Townsend | D2/909 |
| 10,149,512 | B1 * | 12/2018 | Wurtz | A43B 7/1475 |
| 2003/0106240 | A1 * | 6/2003 | Wang | A43B 5/08 36/3 B |
| 2003/0230006 | A1 * | 12/2003 | Dombowsky | A43B 3/163 36/7.6 |
| 2005/0193588 | A1 * | 9/2005 | Dombowsky | A43B 3/16 36/7.5 |
| 2007/0113424 | A1 * | 5/2007 | Bell | A43B 3/16 36/7.3 |
| 2009/0241369 | A1 * | 10/2009 | Votolato | A43B 3/16 36/7.3 |
| 2015/0366281 | A1 * | 12/2015 | Miller | B32B 27/12 428/136 |
| 2016/0066646 | A1 * | 3/2016 | Kim | A43B 7/088 36/25 R |
| 2019/0053575 | A1 * | 2/2019 | Austin | A43B 13/28 |

* cited by examiner

OVERSHOE

CROSS REFERENCE TO RELATED APPLICATION

This application claims the benefit of U.S. provisional patent application No. 62/521,665, filed Jun. 19, 2017, the entire contents of which are incorporated herein by this reference.

FIELD OF THE INVENTION

The invention relates to overshoes that can be worn over work boots and other types of footwear.

BACKGROUND OF THE INVENTION

Galoshes and other overshoes have been devised to protect a person's shoes from rain, snow, and mud, and to provide improved traction on various types of terrain. Although a number of such products are known in the art, a need exists for an improved overshoe having a combination of attributes, including enhanced stability on rough or irregular terrain, greater comfort, and anti-fatigue and anti-skid properties.

SUMMARY OF THE INVENTION

The present invention provides a comfortable overshoe that can be worn with work shoes and boots, dress shoes, athletic shoes, and other types of footwear. The overshoe includes a flexible, resilient sole made of synthetic rubber or a similar elastomeric material, and means for releasably attaching the overshoe to a boot or other footwear. The sole has a flexible, generally planar medial wall, with a plurality of hollow domes formed in and extending from the top side of the medial wall. Discrete support members extend from the bottom of the medial wall and are spaced hexagonally around the underside of each dome. In a preferred embodiment, the support members are tri-radial (three-legged), generally y-shaped support members or ribs. A person wearing a pair of the overshoes will find it quite easy to walk on gravel and other rough or uneven surfaces without the discomfort one feels when walking on such surfaces while wearing normal shoes. The overshoes also lessen the fatigue one experiences when walking for an extended period on hard surfaces. In addition, the overshoe sole has antiskid properties that lessen the likelihood of slipping when walking on smooth surfaces.

BRIEF DESCRIPTION OF THE DRAWINGS

Various features and advantages of the invention will be understood more completely when considered in conjunction with the accompanying drawings, wherein.

DETAILED DESCRIPTION OF THE PREFERRED EMBODIMENT

Figure 1:
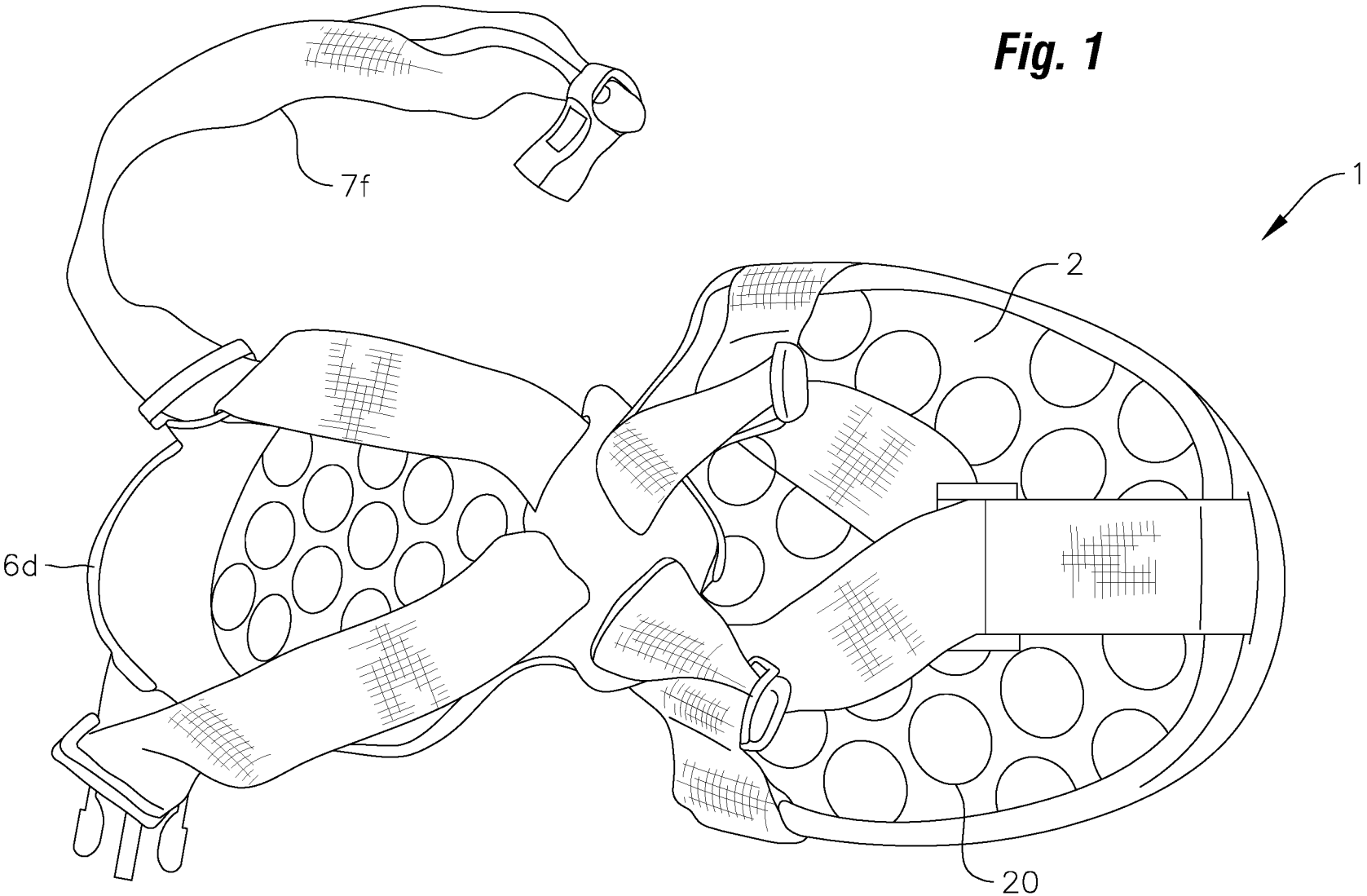
FIG. 1 is a top perspective view of the preferred embodiment of the invention.
Figure 2:
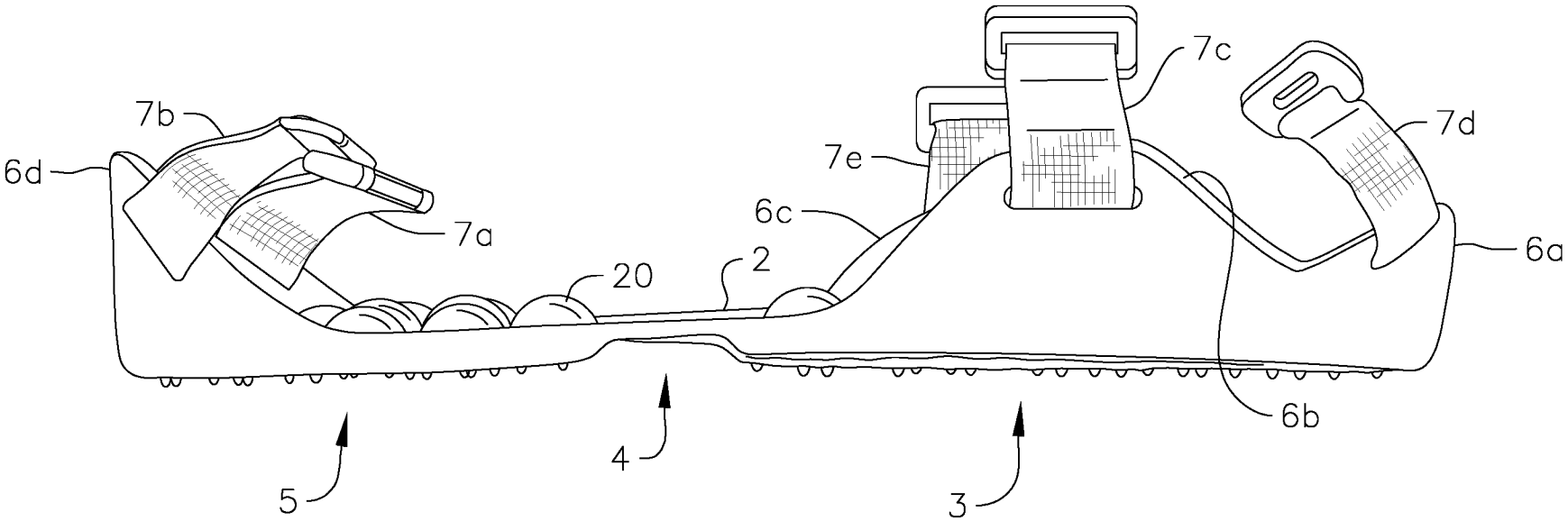
FIG. 2 is a side view of the preferred embodiment, with strap 7*f* removed for clarity.
Figure 3:
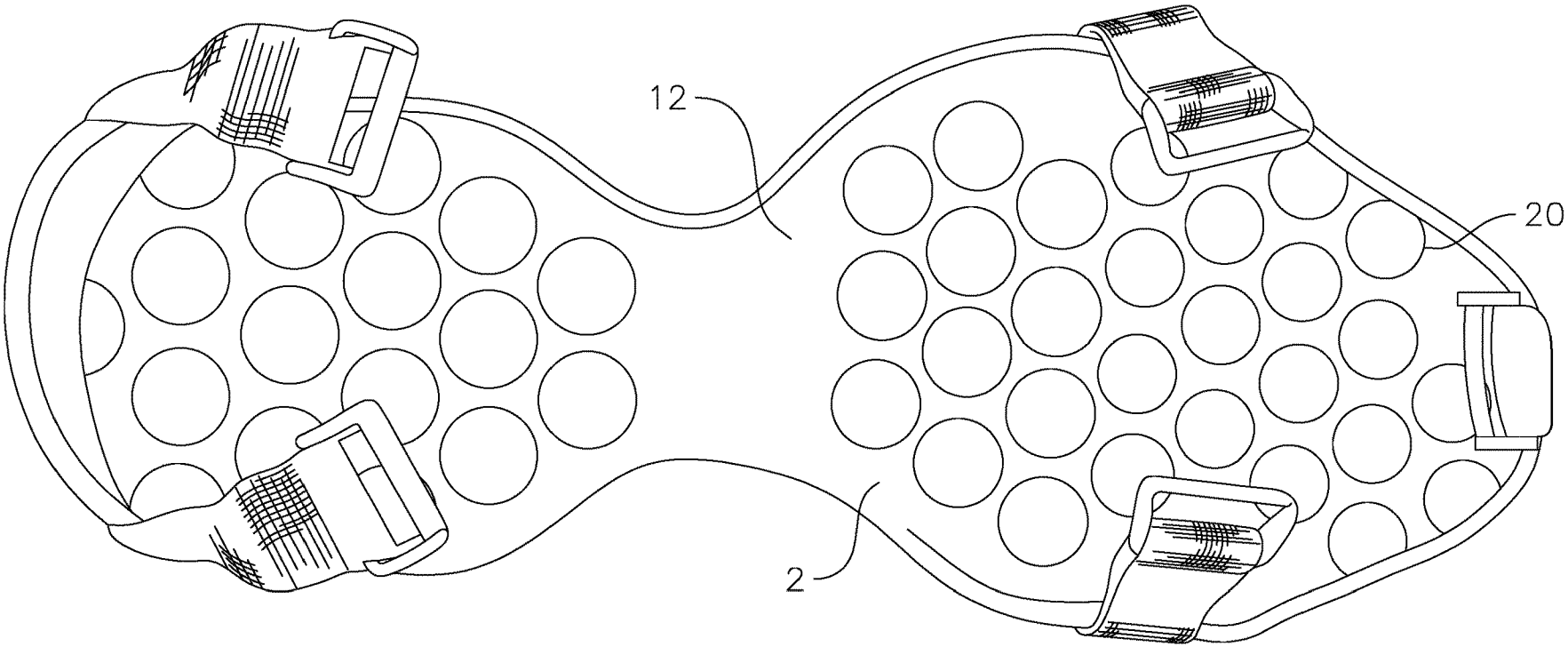
FIG. 3 is a top view of the preferred embodiment, with strap 7*f* removed for clarity.
Figure 4:
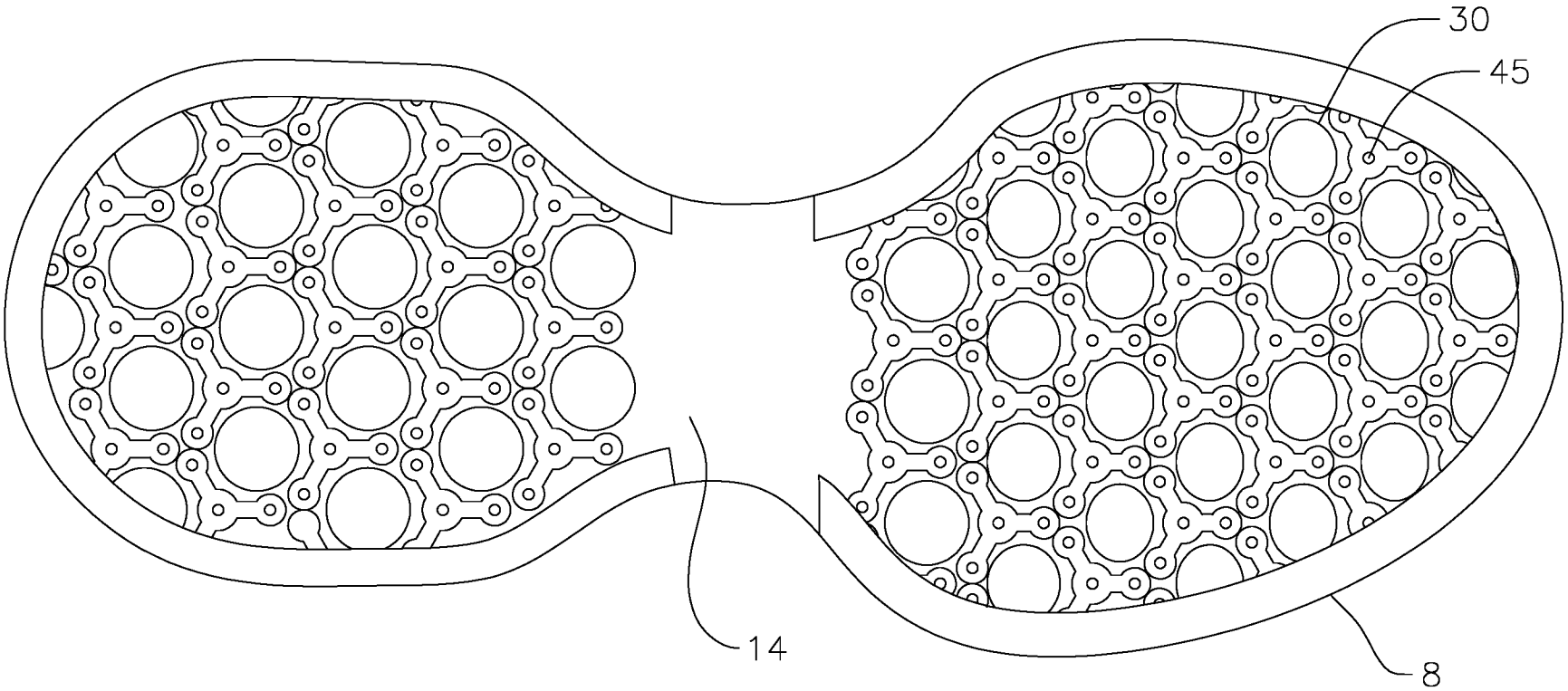
FIG. 4 is a bottom perspective view of the preferred embodiment.

Referring initially to FIGS. 1-4, there is shown an overshoe constructed in accordance with a preferred embodiment of the present invention. The overshoe 1 includes a flexible, resilient sole 2, having a forefoot region 3, midfoot region 4, and hind foot or heel region 5, and means for releasably attaching the overshoe to a work boot or other type of footwear. In this embodiment, the attachment means include slotted tabs 6*a-d* extending generally upward from the perimeter of the sole 2 in the forefoot and hind foot regions, and straps 7*a-f* connected to the tabs. A shoulder 8 is formed along the outer perimeter or edge of the sole, preferably at least where the strap attachment tabs meet the sole.

Figure 6:
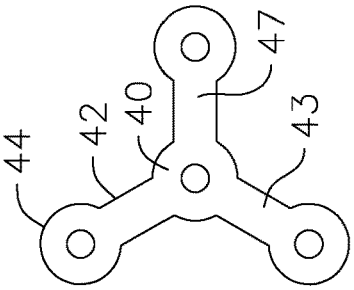
FIG. 6 is a bottom view of a single y-shaped support member of the preferred embodiment.
Figure 5:
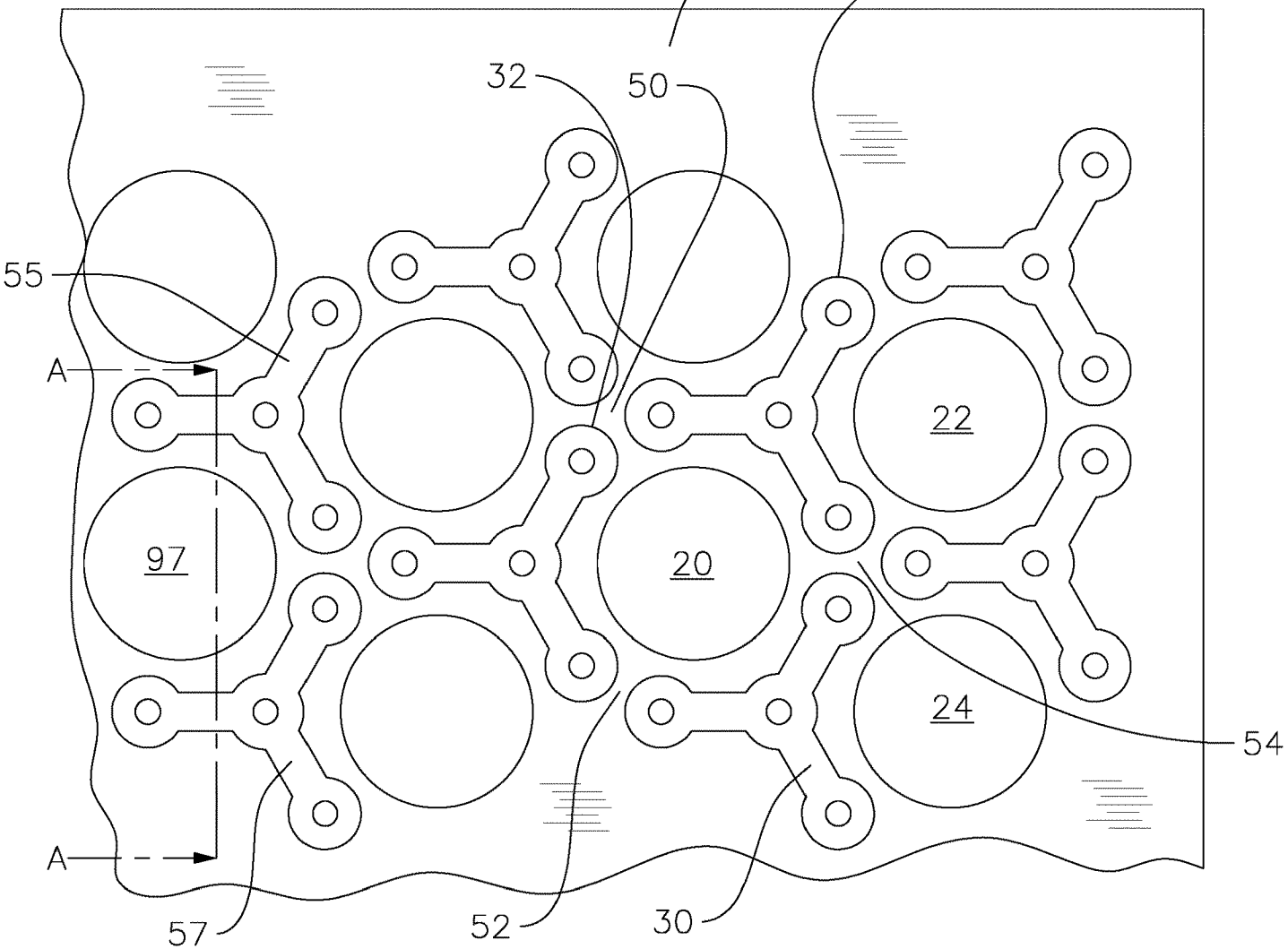
FIG. 5 is a bottom fragmentary view of the preferred embodiment.
Figure 7:
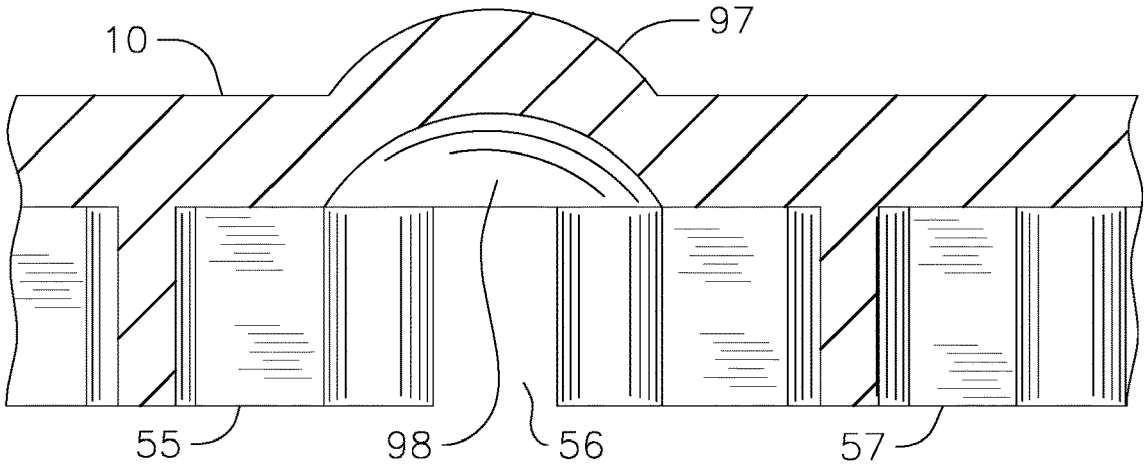
FIG. 7 is a cross-sectional view of the preferred embodiment taken along line A-A in FIG. 5.

Referring now to FIGS. 5-7, the sole 2 includes a flexible, generally planar, medial wall 10, having a top side 12 and a bottom side 14. A plurality of hollow domes 20, 22, etc. are formed in the sole and project upwardly from the top side of the medial wall. A plurality of triradial, generally "y-shaped" support members 30, 32, etc. extend downwardly from the bottom side 14 of the medial wall 10 in the forefoot and hind foot regions of the sole. Within the forefoot and hind foot regions, away from both the midfoot region and the outer periphery of the sole, the underside of each dome is surrounded by a "ring" or hexagon of three, equally spaced apart, triradial support members. For example, in FIG. 5, support members 30, 32, and 34 substantially encircle the underside of dome 20 and provide support there for.

The sole 2, including the medial wall, domes, and support members, and the strap attachment tabs 6*a*-6*d*, are integrally formed as a unitary piece of elastomeric material by compression molding. Nonlimiting examples of such materials include natural and synthetic rubbers, and blends of such materials.

FIG. 6 illustrates a single triradial support member, which includes a solid central core 40 and three legs 42, 43, and 47 extending radially outward from the central core 40, with an angle of 120° between adjacent legs. Each leg has a bulbously enlarged distal end (e.g., end 44). A small knob 45 is formed in and projects downwardly from the central core 40 and distal end of each leg. For clarity, the knobs are not shown in FIGS. 7-10.

Referring again to FIG. 5, it can be seen that for each trio of adjacent triradial support members, an opening is formed wherever the distal end of the leg of one support member is close to the distal end of the leg of an adjacent support member. For example, openings 50, 52 and 54 are formed between the adjacent legs of the support members 30, 32, and 34.

FIG. 7 is a cross-sectional view of a portion of the medial wall 10 taken nearly through the center of a dome 97, which is shown integrally formed with the sole 10. On either side of dome 97 are triradial support members 55 and 57. It can be seen that the dome 97 has a convex outer surface and a concave underside 98. Directly beneath the dome is an open space 56.

The basic structure of the medial wall, domes, and support members is described and illustrated in the context of an antiskid floor mat in U.S. Pat. No. 5,456,966 (Austin), the entire contents of which are incorporated herein by this reference.

When a person wearing the overshoes walks across a surface having numerous irregular features, certain domes and support members may be compressed, deflected, and/or undergo tension as the soles of the overshoes encounter the surface. This cushions the user's feet and provides a very comfortable walking experience. When an overshoe constructed as described herein encounters a hard object, such as a piece of gravel, the sole accommodates the object and either "absorbs" it or dampens the impact felt by the user, in a way that depends on the size of the object and the particular part(s) or region(s) of the sole that strike the object.

Figure 8:
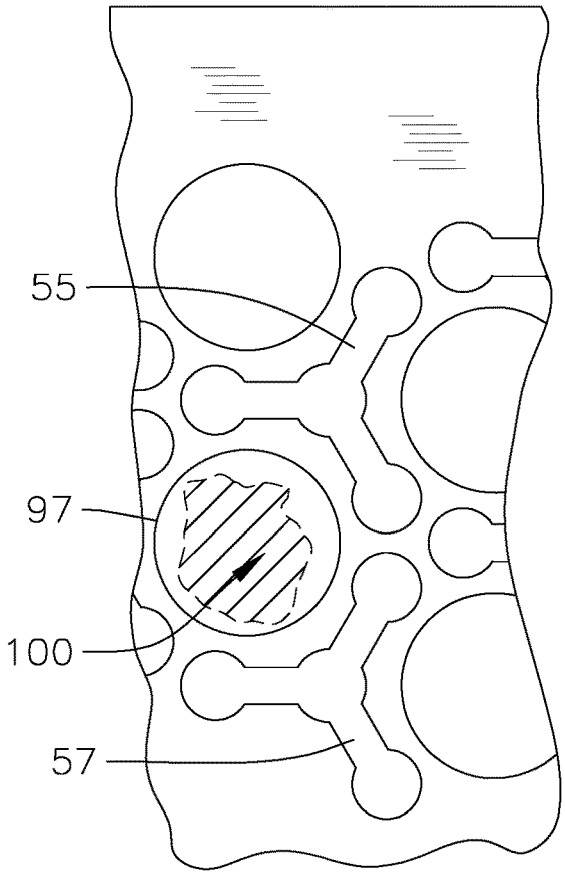
FIG. 8 is a schematic bottom view of a portion of the sole of the overshoe as it encounters an object.
Figure 9:
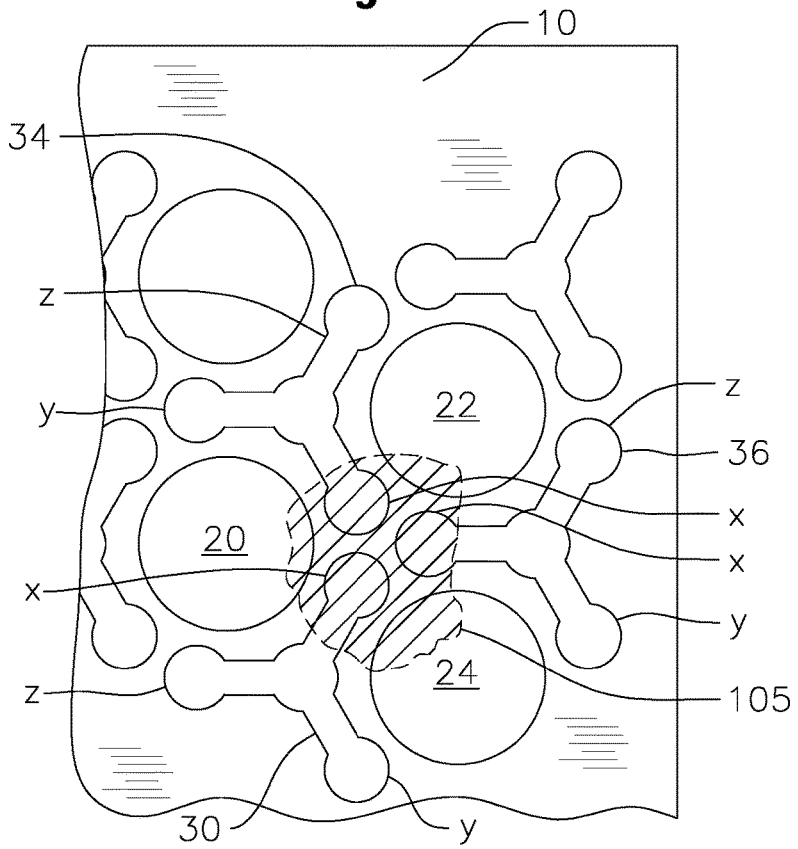
FIG. 9 is a schematic bottom view of another portion of the sole of the overshoe as it encounters an object.
Figure 10:
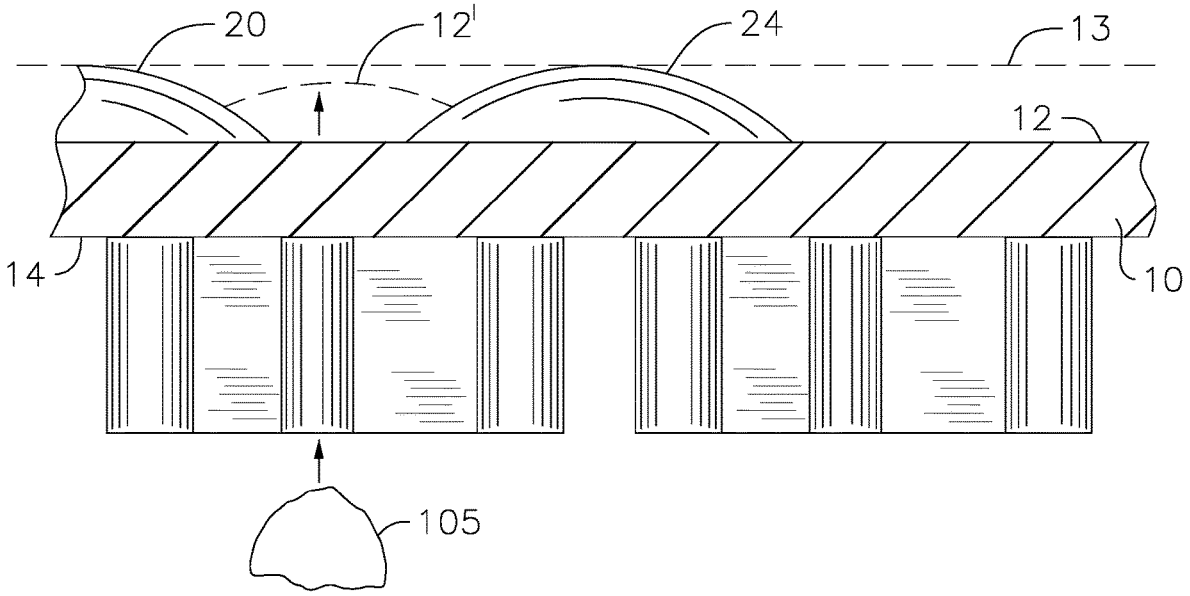
FIG. 10 is a schematic side sectional view of a portion of the sole of the overshoe as it encounters an object.

In FIG. 8, a small rock 100 wholly fits within the underside of a dome 97. In this case, the rock may not even be felt by the person wearing the overshoe. In FIG. 9, three support members 30, 34, 36 press down on a small rock 105. As the support members press down on the rock, the rock presses up on the support members and, by extension, the medial wall 10 of the sole. Depending on the surface topology of the rock, and whether the support members are centered or off-centered (relative to the rock), the legs (denoted "x") of the support members contacting the rock may be compressed, deflected to the side, forced upward, or some combination thereof. Other legs (denoted "y" and "z") may remain in contact with the ground, at least initially. As shown in FIG. 10, the impact with the rock causes the top surface 12 of the sole to be pressed up slightly, within the interstitial space between domes 20, 22, and 24. A slight bulge, denoted by line 12', may be formed in the top surface of the sole. For a small rock, this may barely be felt by the user, especially if the bulge is no higher than the uppermost point of adjacent domes, denoted by line 13. For a larger rock, the force of impact will be spread out over multiple support members.

Many of the advantages of the invention are a result of the flexible, resilient nature of the sole, the unique design of the triradial support members, and the layout of the support members relative to the domes (i.e., each dome within the primary field of the sole—away from the midfoot and the outer perimeter—is supported from below by a hexagonal array of support). The small knobs 45 protruding from the bottom of the support members provide additional cushioning and also extend the life of the sole, as the knobs are gradually worn down by use.

By limiting the width of the midfoot and restricting the domes and support members to the forefoot and hind foot regions, the overshoes have improved flexion, making it easier for a user to traverse irregular and/or bumpy surfaces. Even gravel roads and ADA-compliant sidewalk safety tiles (so-called "truncated domes" paving tiles) can be traversed with ease when wearing the overshoes described herein. In addition, the overshoes provide greater overall cushioning on various surfaces, less fatigue when walking on hard surfaces, and less chance of slippage on smooth surfaces.

If a small stone or other object becomes lodged in the underside of the sole, the flexible support members and domes, and the openings between adjacent support members (e.g., openings 50, 52, and 54 in FIG. 5), permit the object to be removed quite easily.

A pair of overshoes constructed in accordance with the invention can be made to any desired size suitable to accommodate a pair of work shoes or boots, dress shoes, athletic shoes, hiking shoes or boots, or other footwear. As a nonlimiting example, Table 1 presents approximate dimensions for a pair of overshoes made to fit men's size 9 (US) boots.

TABLE 1

Overshoe Dimensions for Size 9 Shoe

| Part or feature | Size |
|---|---|
| Overall length | 12.5 inches |
| Width of forefoot at widest point | 4.75 inches |
| Width of midfoot at narrowest point | 2.0 inches |
| Width of hind foot at widest point | 3.75 inches |
| Medial wall thickness | 187.5 mils |
| Dome height from top of medial wall | 125 mils |
| Dome outer diameter | 0.75 inches |
| Distance between adjacent domes (center-to-center | 1 inch |
| Support member length from bottom of medial wall | 187.5 to 18.75 mils |
| Knob height | 62.5 mils |

The overshoes are easily placed over a pair of shoes or boots and quickly secured by tightening the straps 7 connected to the attachment tabs 6.

While the invention has been described with reference to a preferred embodiment, other embodiments and modifications will be apparent to the skilled person after reading this disclosure. For example, the y-shaped support members can be modified by eliminating the bulbous ends of each leg, and/or the knobs on the bottom of the support members, or by replacing the y-shaped members with dog bone-shaped support members, as shown in the floor mat described in U.S. Pat. No. 4,478,901 (Dickens et al.) (see in particular FIG. 2), the entire contents of the '901 patent being incorporated by reference herein. Other attachment means can be used in place of straps, such as laces or Velcro® fasteners. In addition, if one or more straps are employed, they can be secured to the tabs by snaps, buttons, or other fasteners. The overshoe can employ a full vamp, an extended toe cap or toe box, or even a galoshes-type structure that covers most or all of the user's primary footwear. These and other variations, embodiments, and modification fall within the scope of the present invention, which is limited only by the appended claims and equivalents thereof.

What is claimed is:

1. An overshoe that can be worn on a shoe or boot comprising:

a flexible, resilient sole having a medial wall, a plurality of hollow domes formed in and extending from a top side of the medial wall, and a plurality of tritadial support members extending from a bottom side of the medial wall; and means for releasably attaching the overshoe to the shoe or boot;

wherein each of the plurality of triradial support members is composed of a central core with three legs extending radially outward from the central core, and wherein each leg has a bulbously enlarged distal end, and wherein a small knob projects downwardly from the center of each bulbous distal end.

2. An overshoe that can be worn on a shoe or boot, comprising:

a flexible, resilient sole having a medial wall, a plurality of hollow domes formed in and extending from a top side of the medial wall, and a plurality of tritadial support members extending from a bottom side of the medial wall; and means for releasably attaching the overshoe to the shoe or boot;

wherein each of the plurality of triradial support members is composed of a central core with three legs extending radially outward from the central core, and wherein a small knob projects downwardly from the central core.

* * * * *